United States Patent [19]

Higley

[11] 4,190,155

[45] Feb. 26, 1980

[54] COVERED, PORTABLE INSULATED PLATE

[76] Inventor: Faith Higley, 2003-29 Bay View Heights Dr., San Diego, Calif. 92105

[21] Appl. No.: 959,763

[22] Filed: Nov. 13, 1978

[51] Int. Cl.[2] ..... B65D 1/24; B65D 25/14; B65D 25/28

[52] U.S. Cl. ..... 206/445; 16/110.5; 220/22; 220/94 A; 220/326; 220/339; 220/444; 220/902

[58] Field of Search ..... 16/110.5; 206/543, 545, 206/549, 445; 220/94 A, 412, 22, 444, 23.6, 23.8, 324, 326, 339, 23

[56] References Cited

U.S. PATENT DOCUMENTS

| | | | |
|---|---|---|---|
| Re. 25,530 | 3/1964 | King | 206/545 |
| 1,931,078 | 10/1933 | McWilliams | 16/110.5 |
| 2,161,295 | 6/1939 | Hirschberg | 220/412 |
| 2,656,946 | 10/1953 | Clarke | 206/545 |
| 2,683,478 | 7/1954 | Seelig | 16/110.5 X |
| 2,803,368 | 8/1957 | Koch | 220/324 X |
| 3,093,324 | 6/1963 | Dobrikin | 220/324 X |
| 3,432,025 | 3/1969 | Luhe | 206/545 |
| 3,438,538 | 4/1969 | Peters | 220/94 A X |
| 3,633,785 | 1/1972 | Cyr et al. | 220/339 X |
| 3,705,222 | 12/1972 | Rogers et al. | 206/545 X |
| 3,754,640 | 8/1973 | Bridges | 220/444 X |
| 3,845,875 | 11/1974 | Douglas et al. | 206/545 X |
| 3,938,691 | 2/1976 | Dumas | 220/94 A |

*Primary Examiner*—Allan N. Shoap

[57] ABSTRACT

The invention provides an alternative to the brown bag lunch in the form of an insulated carrying plate having bottom and top members sealed together by releasible fasteners and defining sealed, separated compartments inside, there being a carrying handle incorporating a hinged lid which opens to expose a cavity occupying substantially the entire interior of said handle and useful as a storage compartment for utensils and condiments.

1 Claim, 7 Drawing Figures

COVERED, PORTABLE INSULATED PLATE

BACKGROUND OF THE INVENTION

Traditionally there have been two basic methods of accommodating the lunch needs of a working person. First, the person is always free to go to a nearby restuarant and, second, is the famous "brown bag lunch". Although the purveyors of progress would have the brown bagger carry a lunch box which is more particularly designed to his specific needs, the brown bag has not so yielded, at least not among white collar workers.

Because of this, a brown bag lunch, whether it be carried in an authentic brown bag, in a purse, or fragmented and stuffed into the various pockets of a business suit, almost universally constitutes a sandwich, a bag of peanuts, a Hostess Twinkie and like foods which are pre-packaged, or home-packaged easily in dry wrappers. Unfortunately, these dictates of the American Brown Bag Lunch habit are at that logger heads with simultaneous trends in the country toward healthy food and toward dietetic meals. Those foods ideally suited to those on weight loss diets, special health diets, or diets to accommodate individual health needs, often are not adapted to being carried in a brown bag, purse, suit pocket, or even a lunch box.

There have in the past been designed specialized insulated containers for fast foods and the like, and insulated plates for home use have been created, including those filled with hot water to longer preserve the warmth of the food. However, there has not been developed a convenient portable hot plate capable of completely segregating, and insulating, several portions of any type of food regardless of the temperature or wetness which the food must have in order to be edible.

SUMMARY OF THE INVENTION

The present invention solves the above-mentioned problems by providing a completely self-contained, insulated plate defining not only a series of water tight compartments, but fully insulating these compartments both from the outside air and from one another. The invention comprises top and bottom members releasibly clamped together by any convenient fasteners, and includes a handle on the top member which is hollow having a hinged top and ordinarily would include the utensils required to eat the meal, perhaps a napkin or two, and even salt, pepper, or condiments desired.

The overall shape of the unit is such as not to appear unaesthetic to those who feel their image would not be particularly enhanced by a conventional lunch box in the hand.

DETAILED DESCRIPTION OF THE PREFERRED EMBODIMENT

The invention comprises a lower member 10 and an upper lid or cover member 12 which fits snuggly over the lower member. Both of these members must be well insulated, and this requirement is accommodated in the disclosed invention by means of interior bodies 14 of an insulative foam material. These bodies are encapsulated in a protective and form-defining skin of hard, impervious material 16, which ordinarily would be plastic. Of course, any modification would be possible, provided the interior cavities defined by the upper and lower bodies have water impermeable walls, and the cavity is well insulated.

Figure 5:
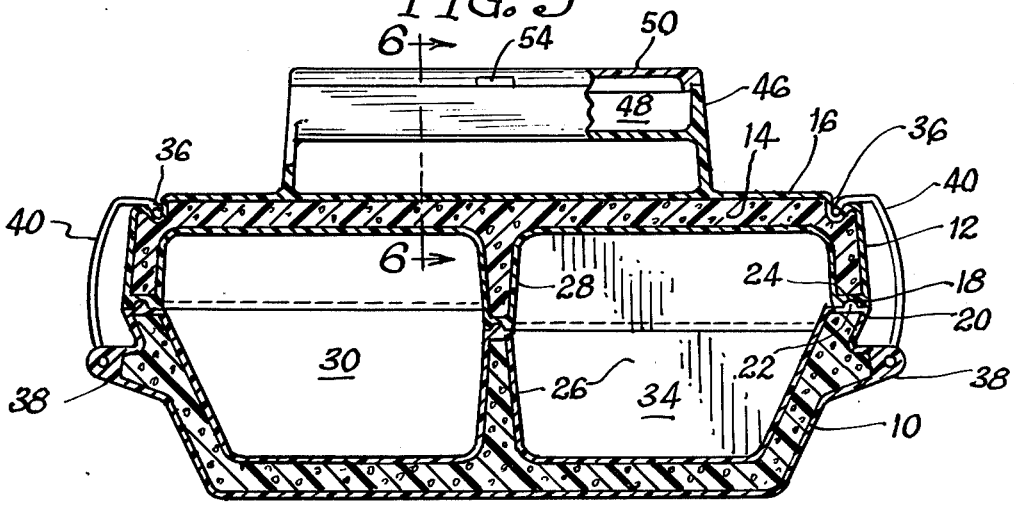
FIG. 5 is a sectional view taken along line 5—5 of FIG. 3.
Figure 6:
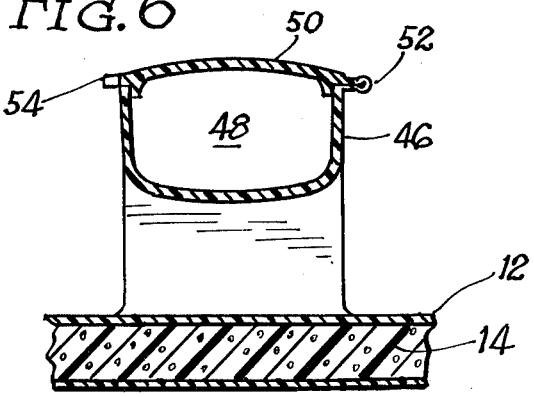
FIG. 6 is a sectional view taken along lines 6—6 of FIG. 5.

The upper and lower members have peripheral edges 18 and 20 which snuggly mate as shown in FIG. 5, preferably having some interlocking structures such as continuous bead 22 which seats in the trough 24. Ideally, the material defining the bead, the trough, or both, would be resilient so that the seal is perfected. Otherwise, some type of gasket could be utilized as will be described in regard to FIG. 7.

Figure 1:
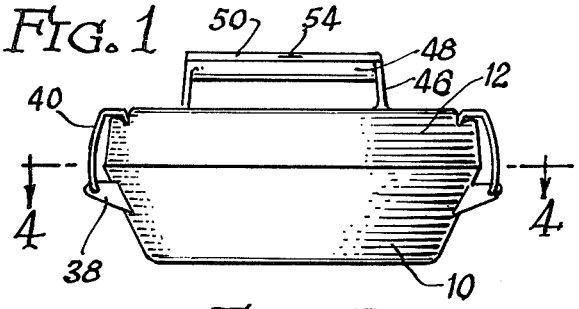
FIG. 1 is a side elevation view of the insulated portable plate.
Figure 2:
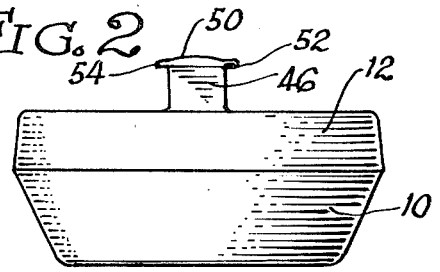
FIG. 2 is an end elevation view of the plate of FIG. 1.
Figure 3:
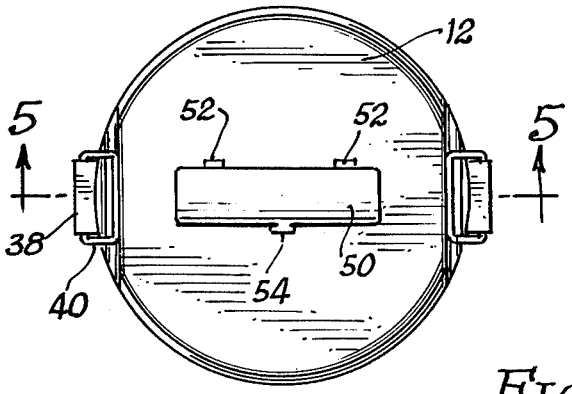
FIG. 3 is a top elevation view of the plate of FIG. 1.
Figure 4:
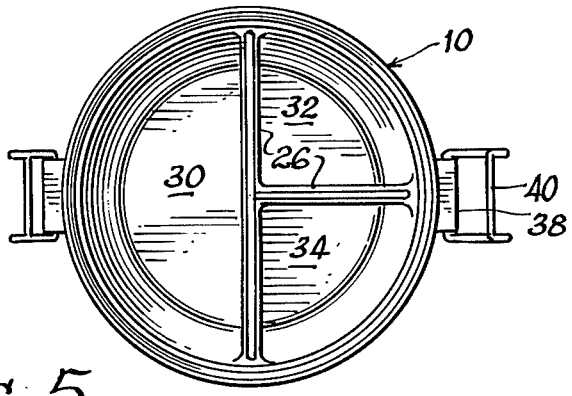
FIG. 4 is a sectional view taken along line 4—4 of FIG. 1.

In addition to the peripheral seal and the mating of the outer edges, as is best seen in FIG. 4 of the lower member, includes a continuous partition 26 that divides the lower member into an indefinite number of separate compartments, three being shown in FIG. 4 It is intended that these compartments would contain a complete meal, such as a meat dish or casserole in the larger compartment, perhaps a vegetable in some liquid in another compartment, and a light dessert in another compartment. Therefore, it can be seen that perfection of the device would incorporate structure in the upper member such as depending partition 28 which snuggly mates in compressed relation against the entire length of the continuous lower partition 26. This sealing relation accomplishes the separate definition of three fully-insulated, impermeable compartments 30, 32 and 34. Thus, cold foods are insulated from hot foods by virtue of the insulation in both upper and lower partition, and the liquid from one compartment is not permitted to spread onto another. Although it is clearly designed to be carried in an upright position, accidental overturning of the insulated plate, or its storage on edge, would not cause a disaster. It can be seen from FIG. 5 that the bead 22 and trough 24 of the edges of the upper and lower edges continue through the partitions to facilitate a definition of the tight seal desired.

Again referring to FIG. 5, the upper body 12 defines a pair of grooves 36 and the lower body has opposite directed bail mounts 38 in which are pivitally hinged bails or clips 40, resilient enough to snap free of the grooves 36 in order to remove the upper member from the lower.

Figure 7:
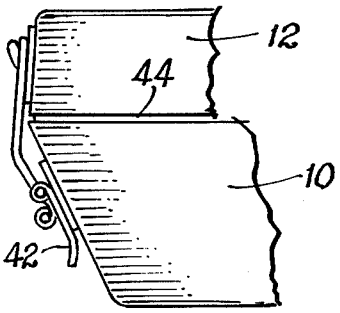
FIG. 7 is a fragmentary view of the edge of the plate showing a modified fastener and a sealing gasket.

An alternative fastener means is shown in FIG. 7, wherein an over-the-center trunk latch 42 is used in conjunction with a resilient gasket 44. Depending on the strength of the members, the trunk latches 44 as an alternative to the to the bails 40 would create a more compressed relation between the two members.

The top of the upper member mounts an elongated handle 46 which defines an interior cavity 48. The handle, as can be seen in FIG. 5, is integrally connected to the wall material at 16 of cover 12 by means of integral leg members. The top of the cavity and the handle is formed by a hinged cover 50, the hinges 52 are preferably simply molded unitarily with the cover and the bottom portion defining the cavity. The cavity is of sufficient extent to contain small plastic eating utensils, as well as napkins, small salt and pepper shakers or other condiments or spices desired. Some means can also be incorporated with the materials in this cavity to wipe out the plate once it is finished, such as a packaged wet towelette or the like. The side of the cover 50 opposite the hinges 52 is provided with an integral catch 54, also preferably molded integrally with the other structure.

The structure thus presented provides a viable alternative to the brown bagger and permits him or her to carry any manner of food desired for his or her lunch. No longer is the dieter or health enthusiast strained to think of some form of sandwich which is low in claories or high in the food nutrients desired, nor must the food be dry, or edible only at room temperature. Substantially any meal which could be prepared by the person at home can be carried to work in the container described and claimed herein.

I claim:

1. An insulative carrying case comprising:

(a) a lower insulative plate-defining member having impervious inner and outer wall surfaces with an insulation material therebetween, said member defining a first continuous peripheral edge and a first continuous vertical partition compartmentalizing said lower member;

(b) an insulative upper cover member having a second continuous edge metable with said first edge and a second continuous vertical partition matable with the first partition; said upper cover member having impervious inner and outer wall surfaces with an insulation material therebetween;

(c) fastening means to releasibly fasten said upper and lower members together in compressed relation with the edges and partitions sealingly mated to define a plurality of generally horizontally aligned and extended, sealed and mutually separate compartments;

(d) a carrying handle comprising a horizontally extended bar defining a hollow interior cavity having a hinged integral cover lid for the containment of utensils and food condiments, said handle being supported by leg members integrally, unitarily connected to said bar and integrally, unitarily connected to the outer wall surface of said upper member substantially above the combined centers of gravity of said upper and lower member whereby a typical multi-course meal may be transported and stored for a number of hours while maintaining substantial temperature integrity and spacial fidelity to a conventionally served meal.

* * * * *